United States Patent [19]

Theurich

[11] 3,946,942

[45] Mar. 30, 1976

[54] GAS CENTRIFUGE PURGE METHOD

[75] Inventor: Gordon R. Theurich, Oak Ridge, Tenn.

[73] Assignee: The United States of America as represented by the United States Energy Research and Development Administration, Washington, D.C.

[22] Filed: July 12, 1963

[21] Appl. No.: 294,774

[52] U.S. Cl. ..... 233/40; 233/16; 233/DIG. 1

[51] Int. Cl.[2] ..... B04B 1/00

[58] Field of Search ..... 233/24, 26, 27, 28, 16, 233/17, 18, 34, 38, 45–47, 40, DIG. 1; 73/388, 389, 391

[56] References Cited

UNITED STATES PATENTS

| | | | |
|---|---|---|---|
| 2,733,857 | 2/1956 | Beams | 233/24 |
| 3,108,955 | 10/1963 | Boyland | 233/27 |

FOREIGN PATENTS OR APPLICATIONS

| | | | |
|---|---|---|---|
| 572,830 | 11/1958 | Belgium | 233/24 |
| 909,235 | 10/1962 | United Kingdom | 233/DIG. 1 |

*Primary Examiner*—Stephen J. Lechert, Jr.
*Attorney, Agent, or Firm*—Dean E. Carlson; David S. Zachry; Stephen D. Hamel

EXEMPLARY CLAIM

1. In a method of separating isotopes in a high speed gas centrifuge wherein a vertically oriented cylindrical rotor bowl is adapted to rotate about its axis within an evacuated chamber, and wherein an annular molecular pump having an intake end and a discharge end encircles the uppermost portion of said rotor bowl, said molecular pump being attached along its periphery in a leak-tight manner to said evacuated chamber, and wherein end cap closure means are affixed to the upper end of said rotor bowl, and a process gas withdrawal and insertion system enters said bowl through said end cap closure means, said evacuated chamber, molecular pump and end cap defining an upper zone at the discharge end of said molecular pump, said evacuated chamber, molecular pump and rotor bowl defining a lower annular zone at the intake end of said molecular pump, a method for removing gases from said upper and lower zones during centrifuge operation with a minimum loss of process gas from said rotor bowl, comprising, in combination: continuously measuring the pressure in said upper zone, pumping gas from said lower zone from the time the pressure in said upper zone equals a first preselected value until the pressure in said upper zone is equal to a second preselected value, said first preselected value being greater than said second preselected value, and continuously pumping gas from said upper zone from the time the pressure in said upper zone equals a third preselected value until the pressure in said upper zone is equal to a fourth preselected value, said third preselected value being greater than said first, second and fourth preselected values.

5 Claims, 2 Drawing Figures

Figure 1:
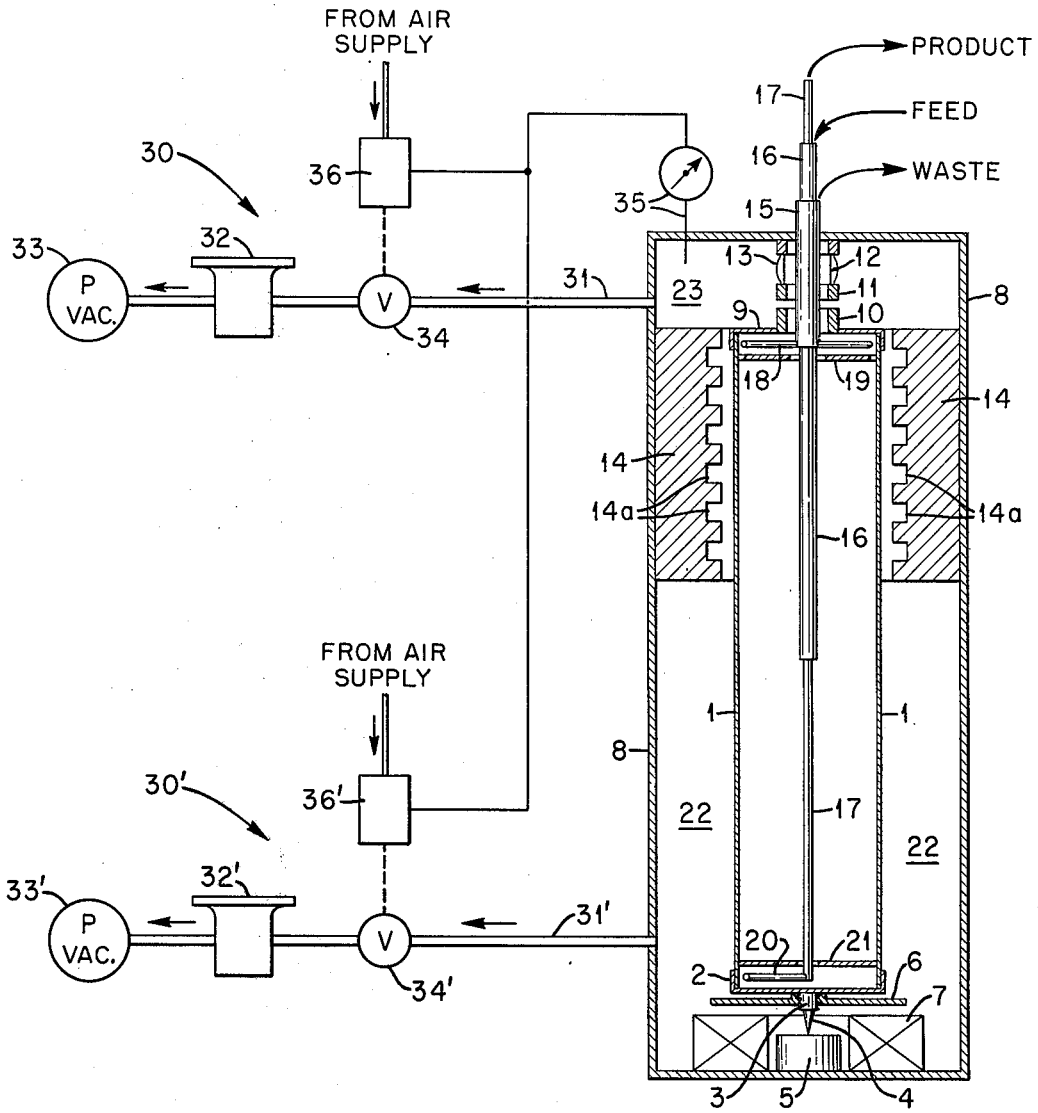

INVENTOR.
Gordon R. Theurich
BY
Roland A. Anderson
ATTORNEY.

INVENTOR.
Gordon R. Theurich

BY
Roland A. Anderson

ATTORNEY.

GAS CENTRIFUGE PURGE METHOD

This invention relates generally to high speed gas centrifuges and more particularly to a method of removing undesirable lightweight gas contaminants from a high speed gas centrifuge.

In a high speed gas centrifuge utilizing a vertically oriented cylindrical rotor bowl spinning within an evacuated casing, lightweight gas contaminants tend to accumulate in the bowl axial region while the heavier process gas gathers in the bowl peripheral region. As a gas centrifuge of this type typically has gas addition and removal apparatus entering through a central opening in the top end of the rotor bowl, the light gas contaminants tend to diffuse through the top opening into the casing to rotor bowl volume surrounding the rotor bowl. Typically, an annular molecular pump surrounds the uppermost part of the rotor bowl to prevent the gas which diffuses out of the top of the rotor bowl from reaching this rapidly moving bowl side.

The accumulation of light gas contaminants in a gas centrifuge is objectionable for several reasons. For example, as pointed out above, the lightweight contaminants tend to diffuse into the casing to rotor volume surrounding the rotor bowl. Lightweight contaminants markedly reduce the effectiveness of the molecular pump and as a result cause the gas pressure to increase in the casing to rotor zone below the molecular pump. This increase in pressure causes an increase in drag on the spinning rotor which in turn causes an increase in rotor temperature and mechanical instability. The increase in rotor temperature upsets the flow mechanism within the rotor, thereby decreasing the separative capacity of the system. The accumulation of lightweight contaminants in a gas centrifuge, therefore, can lead to a decrease in separate efficiency, possible complete centrifuge failure and an increase in power requirements to drive the rotor bowl.

Gas centrifuges in cascade arrangement provide an additional problem in removing lightweight gas contaminants. With large numbers of machines in a cascade, only a very small fraction of process gas can be removed from each machine with the light gas contaminants. The effect of even very limited removal of process gas from each machine in a cascade can render a large cascade so inefficient so as to be inoperable. Large cascades are necessary when separating gases of heavy isotopes such as $U^{235}F_6$ and $U^{238}F_6$ where the molecular weights are almost equal and the separation factor is fairly small.

It is, therefore, a general object of the invention to provide a method for removing light gas contaminants from a continuously operating gas centrifuge while minimizing the removal of process gas therefrom.

Another object of the invention is to provide a method for removing the light gas contaminants from a continuously operating gas centrifuge at a predetermined rate when the proportion of light gas contaminants in the process gas in a selected range, and to remove light gas contaminants at a predetermined higher rate when the proportion of light gas contaminants exceeds that range.

Another object of the invention is to provide a method whereby gas centrifuges can be operated in a cascade arrangement with essentially uniform pressures from machine to machine.

Still another object of the invention is to provide a method wherein light gas contaminants are removed only when they exceed a predetermined concentration.

Yet another object of the invention is to provide a method for removing light gas contaminants wherein contaminants having a minimum concentration of process gas mixed therewith are preferentially removed.

Figure 2:
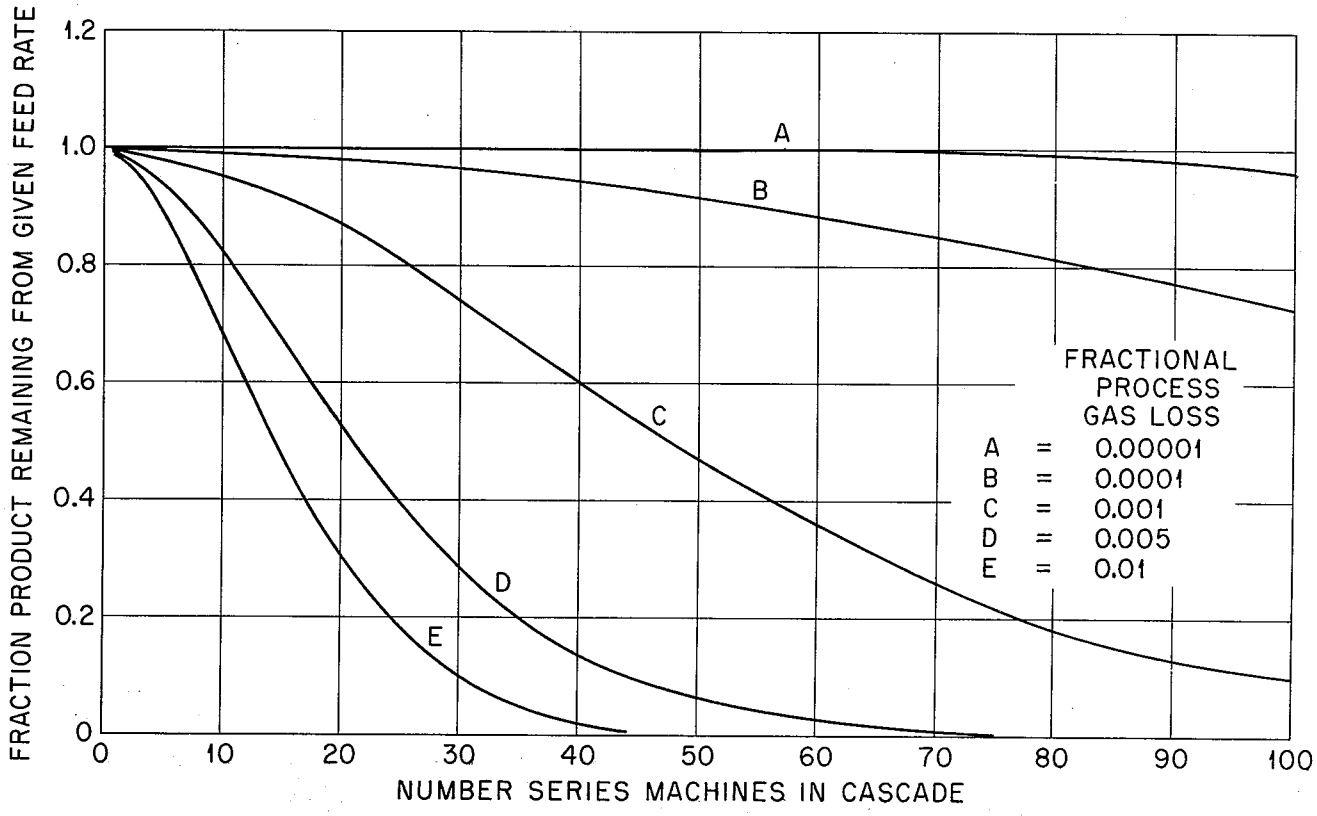

Other objects of the invention will become apparent from an examination of the following description of the invention and the drawings appended thereto, wherein:

FIG. 1 is a schematic illustration of a gas removal system designed in accordance with the subject invention as utilized for use with a typical Zippe type gas centrifuge, where a tubular rotor rotates about a vertical axis on a thin flexible needle and a tube assembly enters through the top of the rotor to add and remove process gas and FIG. 2 is a graph illustrating the effect of process gas losses on gas centrifuge machines in a cascade arrangement.

In accordance with the present invention, the above listed objects are provided by a method for removing undesirable lightweight gas contaminants from high speed gas centrifuges, which comprises, in combination, continually measuring the gas pressure in the centrifuge vacuum casing to rotor zone above the molecular pump, pumping gas from the vacuum casing to rotor zone below the molecular pump when the pressure in the vacuum casing to rotor zone above the molecular pump exceeds a first preselected value, and pumping gas from the vacuum casing to rotor zone above the molecular pump when the pressure in that zone exceeds a second preselected value greater than the first. In practice, gas is removed from the vacuum casing to rotor volume only when the concentration therein exceeds a first predetermined value. When the first predetermined value is exceeded, gas is preferentially withdrawn from the vacuum casing-to-rotor zone below the molecular pump. If the pressure continues to rise, pumping is then initiated from the vacuum casing to rotor zone above the molecular pump.

In order to facilitate an understanding of the invention, reference is made to FIG. 1 of the accompanying drawings wherein a preferred embodiment designed in accordance with the subject invention is shown as utilized for use with a gas centrifuge of the typical Zippe type used in separating the $U^{235}$ isotope in uranium hexafluoride gas.

The Zippe type centrifuge schematically illustrated in FIG. 1 comprises an elongated vertically oriented rotor bowl 1 whose lower end is closed leak-tight by means of an end cap 2. The bottom face of the cap 2 is formed with a rigid axial extension 3 which is externally threaded and which terminates in an axially aligned, flexible steel needle 4. The point of the needle is centered in a depression provided in a damped support block 5. Means (not shown) are provided to lubricate the needle and support block, and to damp axial and lateral vibrations of the block 5. Threaded onto the end cap extension 3 is a plate-type armature 6 which is rotated by a three-phase field winding 7 mounted below the armature. An evacuated casing 8 encloses the rotor bowl 1 and associated components 2–6.

As shown, an end cap 9 is sealably assembled to the top end of rotor bowl 1. A cylindrical permanent magnet 10 is rigidly joined to the upper face of the end cap 9, the magnet 10 being in axial alignment with the bowl assembly. Spaced above the magnet 10 and in axial alignment therewith is a similar magnet 11, which is supported from the casing 8 by a suitable support 12. The magnets 10 and 11 are mounted in a mutually attracting relationship, thus reducing the load on the needle 4 and restraining movement of the rotor bowl 1 from the vertical position. A suitable damping device 13 is connected between the upper magnet 11 and the casing 8 to provide damping.

Mounted within the casing 8 and coaxial with the rotor bowl 1 is a grooved cylinder 14 designed to act as a molecular pump. As shown, the pump 14 encompasses only the upper section of rotor bowl 1, the spacing therebetween being made very small to promote molecular pumping. The inner face of the pump is provided with grooves 14*a* which extend from one end of the pump to the other in a helical path. The grooves 14*a* are designed so that rotation of the rotor in the normal direction will cause gas to flow upwardly through the pump. Thus, throughout a normal operation the pump 14 maintains a low pressure in the region surrounding the rotor bowl 1.

As shown, three stationary concentric tubes 15, 16 and 17 are passed into the centrifuge along its axis. The tubes, which extend into the rotor bowl 1, are passed through the top end of the casing 8, the magnets 10 and 11, and the upper end cap 9. The outermost tube 15 is sealed circumferentially to the top end of casing 8. As indicated, the tube 15 terminates in two oppositely extending arms 18 extending radially within the uppermost part of rotor bowl 1. The arms 18, referred to collectively as the top gas scoop, extend close to the wall of the rotor bowl. The tips of the gas scoop are bent in opposite directions to form Pitot tubes which lie in a horizontal plane and which open against the rotating process gas stream within the rotor bowl. An upper plate-like baffle 19, positioned just below the scoop 18, is rigidly joined to the rotor bowl 1. The upper baffle is provided with a central opening to permit gas flow and for passage of the tube assembly. The upper baffle is also formed with peripheral slots to permit gas flow.

The innermost tube 17 extends close to the bottom of rotor bowl 1 and terminates in a transversely extending arm 20 provided with a gas scoop of the kind previously described. The spacing between the wall of the rotor bowl and the top and bottom gas scoops 18 and 20 is essentially the same. A lower plate-like baffle 21, positioned just above the lower gas scoop 20, is rigidly joined to the rotor bowl 1. The lower baffle, which provides shielding for the lower gas scoop, is formed with a central opening for passage of tube 17.

Referring again to the tube assembly, it is noted that the intermediate tube 16 ends about midway between the ends of the rotor bowl 1, and that it is in direct communication with the central region of the rotor bowl. Spacing is provided between the intermediate tube 16 and tubes 15 and 17 so that the tube assembly provides three gas passageways.

As shown in FIG. 1, a gas removal system designed in accordance with the subject invention comprises a top gas withdrawal system 30 and a bottom gas withdrawal system 30'. The bottom system 30' includes a withdrawal line 31', one end of which is connected into the casing to rotor zone 22 of the centrifuge at a point below the molecular pump. The line 31' is connected through a $UF_6$ cold trap 32' to the inlet of a standard diffusion pump 33'. Several suitable $UF_6$ cold traps of suitable design are described on pages 464 and 465 of Uranium Production Technology, edited by Harrington and Ruehle, and published by D. Van Nostrand Company, Inc. Thermal pumps or chemical adsorption pumps could serve as alternate pumping means. An automatically operated block valve 34' is connected to the line 31' between the trap and the centrifuge. As shown, pressure sensing means 35, such as a conventional Pirani gauge is connected into the casing to rotor zone 23 above the molecular pump to generate an electrical signal output proportional to the pressure therein. The signal from the pressure sensing means 35 is fed into an actuating means 36' which is adapted to open the valve 34' when the signal from the pressure sensing means exceeds a first preselected value, and to close valve 34' when the signal drops below a second preselected value less than the first preselected value. The value 34' may be an air-operated valve and the actuating means 36' a relay which energizes a solenoid-actuated air operator which in turn drives a piston member mechanically linked to the valve.

The top gas withdrawal system 30 is generally similar to the bottom system just described and comprises a withdrawal line 31, a trap 32, a pump 33, a block valve 34, and a valve-actuating means 36. The withdrawal line 31 is, however, connected into the casing-to-rotor zone 23 of the centrifuge above the molecular pump. The same pressure-sensing means 35 is connected to control the opening and closing of both valves 34 and 34'. The valve operator 36 is connected to receive the signal from pressure-sensing means 35, but is preset to operate only when the valve of the signal reaches a third preselected value which exceeds that of the aforementioned first preselected signal value by a selected amount.

During a typical centrifuge operation the valve 34' is opened automatically if the pressure in the casing-to-rotor zone 23 above the molecular pump exceeds the first preselected value previously discussed. The diffusion pump 33' then withdraws gas continuously from the casing-to-rotor zone 22 below the molecular pump. The gas in zone 22 has been preferentially enriched in light gas contaminants first by the action of the centrifugal field developed by the centrifuge and secondly by the action of the molecular pump which preferentially removes the heavier $UF_6$ process gas components. If the pressure in zone 23 continues to rise until the previously described third predetermined value is reached, the valve 34 also is opened. Such a pressure rise may occur because of gross inleakage of air through casing 8, for example. When the valve 34 is opened, diffusion pump 33 removes gas from zone 23 above the molecular pump while diffusion pump 33' continues to remove gas from zone 22 below the molecular pump. The gas removed from zone 23 has been preferentially enriched in light gas contaminants only by the action of the centrifugal field. Therefore, it is desirable to minimize pumping from zone 23 in order to minimize losses of process gas. In a properly designed system for enriching $UF_6$ in the $U^{235}$ isotope, virtually all pumping will be from zone 22. Valve 34 will be opened only in the event of a gross system disturbance or other events which might prove injurious to the centrifuge system. A fourth predetermined value of pressure in region 23 slightly lower than the above third predetermined value will cause valve 34 to be closed. Typical of the above first, second, third and fourth preselected values of gas pressure in zone 23 are 15 microns of Hg. absolute, 10 microns of Hg. absolute, 30 microns of Hg. absolute, and 25 microns of Hg. absolute, respectively, in a gas centrifuge enriching $UF_6$ in the $U^{235}$ isotope.

Preferably, the bottom withdrawal system 30' is designed with sufficient capacity to maintain very low gas pressures about the rotor bowl despite normal air inleakage, outgassing, and the like. In a practical gas centrifuge cascade in which the present invention is especially desirable, a pumping time would be selected which would reflect an optimum economic balance between the cost of pumping and reprocessing product lost in removing light gas contaminants, and the cost of securing high purity feed and leak-tight equipment.

The top withdrawal system is designed to provide sufficient supplementary capacity to remove light contaminants in the event of abnormal process operation. This supplementary system preferably is connected into the region above the molecular pump to take advantage of the faster pumping available at the higher pressures in this region and to avoid the difficulties inherent in pumping gas backward through the molecular pump. The bottom withdrawal system 30' is preferred for routine use because it removes gas containing a low percentage of the heavier process gas due to the preferential pumping characteristics of the molecular pump for heavier molecular weight gases.

FIG. 2 is a graph illustrating the effect of process gas losses on various cascade arrangements of gas centrifuge machines operated at a cut of one-half. In the calculation of curves A, B, C, D and E having respective fractional process gas losses of 0.00001, 0.0001, 0.001, 0.005 and 0.01 per individual gas centrifuge machine, the molar flow rates of the enriched and depleted streams are assumed about equal. The ordinate of FIG. 2 represents the fraction of product remaining from any given feed rate as compared to a no-leak cascade and the abscissa represents the number of gas centrifuges in series in a cascade arrangement. As indicated by curve C, which is representative of systems pumping only from upper region 23, in a cascade having 50 machines in series and only one-thousandth of the process gas lost per machine, less than half of the product which would be realized from a no-leak system is obtained.

FIG. 2 clearly illustrates the need for a method of removing light gas contaminants wherein only very small quantities of process gas are lost from gas centrifuges in cascade arrangement. Applicant's method of removal, using preferential pumping to minimize process gas losses, permits the use of very large cascade without reducing product output to such a low value that the cascade would be considered inoperable. With a properly designed $UF_6$ system, applicant's method of removing light gas contaminants should minimize process gas losses to a value associated with curve A.

Since many modifications of and deviations from the embodiment disclosed herein may be made without departing from the spirit and scope of the present invention, the foregoing illustrative description of the embodiment should not be interpreted in a limiting sense. The invention should be limited only by the claims appended hereto.

What is claimed is:

1. In a method of separating isotopes in a high speed gas centrifuge wherein a vertically oriented cylindrical rotor bowl is adapted to rotate about its axis within an evacuated chamber, and wherein an annular molecular pump having an intake end and a discharge end encircles the uppermost portion of said rotor bowl, said molecular pump being attached along its periphery in a leak-tight manner to said evacuated chamber, and wherein end cap closure means are affixed to the upper end of said rotor bowl, and a process gas withdrawal and insertion system enters said bowl through said end cap closure means, said evacuated chamber, molecular pump and end cap defining an upper zone at the discharge end of said molecular pump, said evacuated chamber, molecular pump and rotor bowl defining a lower annular zone at the intake end of said molecular pump, a method for removing gases from said upper and lower zones during centrifuge operation with a minimum loss of process gas from said rotor bowl, comprising, in combination: continuously measuring the pressure in said upper zone, pumping gas from said lower zone from the time the pressure in said upper zone equals a first preselected value until the pressure in said upper zone is equal to a second preselected value, said first preselected value being greater than said second preselected value, and continuously pumping gas from said upper zone from the time the pressure in said upper zone equals a third preselected value until the pressure in said upper zone is equal to a fourth preselected value, said third preselected value being greater than said first, second and fourth preselected values.

2. The method of claim 1 wherein said first preselected value of pressure lies within the range from 2 to 25 microns of Hg. absolute, said second preselected value of pressure lies within the range from 1 to 20 microns of Hg. absolute, said third preselected value of pressure lies within the range from 4 to 40 microns of Hg. absolute, and said fourth preselected value of pressure lies within the range from 3 to 35 microns of Hg. absolute.

3. In a method of increasing the uranium 235 isotope concentration in uranium hexafluoride process gas using a gas centrifuge, wherein said process gas is rapidly spun in a vertically oriented cylindrical rotor bowl, said rotor bowl being adapted to rotate about its axis within an evacuated chamber, and wherein an annular molecular pump having an intake end and a discharge end encircles the uppermost portion of said rotor bowl said molecular pump being attached along its periphery in a leak-tight manner to said evacuated chamber, and wherein end cap closure means are affixed to the upper end of said rotor bowl, and a process gas withdrawal and insertion system enters said rotor bowl through said end cap closure means, said evacuated chamber molecular pump and end cap defining an upper zone at the discharge end of said molecular pump, said evacuated chamber, molecular pump and rotor bowl defining a lower annular zone at the intake end of said molecular pump, a method for removing gases from said upper and lower zones during centrifuge operation with a minimum loss of process gas, comprising, in combination: continuously measuring the pressure in said upper zone, continuously pumping gas from said lower zone from the time the pressure in said upper zone equals a first predetermined value until the pressure in said upper zone is equal to a scond preselected value, said first preselected value being greater than said second preselected value, and trapping said process gas from said gas being pumped from said lower zone; continuously pumping gas from said upper zone from the time the pressure in said upper zone equals a third preselected value until the pressure in said upper zone is equal to a fourth preselected value, said third preselected value being greater than said first, second an fourth preselected values, and trapping said process gas from said gas being pumped from said upper zone.

4. The method of claim 3 wherein said fourth preselected value of pressure is less than said first preselected value and greater than said second preselected value.

5. The method of claim 3 wherein said first preselected value of pressure lies between the range from 2 to 20 microns of Hg. absolute, said second preselected value of pressure lies within the range from 1 to 15 microns of Hg. absolute, said third preselected value of pressure lies within the range from 4 to 35 microns of Hg. absolute, and said fourth preselected value of pressure lies within the range from 2 to 30 microns of Hg. absolute.

* * * * *